United States Patent [19]

Vasquez et al.

[11] 4,195,496

[45] Apr. 1, 1980

[54] ADJUSTABLE LENGTH CIRCULAR KNITTING NEEDLE

[76] Inventors: Christine M. Vasquez, 30690 Vanderbilt; Linda L. Rawlins, 102 Hermes Ct., both of Hayward, Calif. 94544

[21] Appl. No.: 902,943

[22] Filed: May 4, 1978

[51] Int. Cl.[2] ..... D04B 35/02

[52] U.S. Cl. ..... 66/117

[58] Field of Search ..... 66/117, 118, 1 A; 223/102, 103

[56] References Cited

U.S. PATENT DOCUMENTS

| | | | |
|---|---|---|---|
| 373,372 | 11/1887 | King | 223/102 X |
| 389,235 | 9/1888 | McBrayer | 223/102 X |
| 891,358 | 6/1908 | Morgan | 223/104 |
| 1,999,691 | 4/1935 | Graham | 66/117 |
| 2,096,482 | 10/1937 | Cook et al. | 66/117 |
| 2,622,776 | 12/1952 | Beverino | 223/102 |

FOREIGN PATENT DOCUMENTS

| | | | |
|---|---|---|---|
| 606762 | 12/1934 | Fed. Rep. of Germany | 66/117 |
| 1807772 | 5/1970 | Fed. Rep. of Germany | 66/117 |
| 2016813 | 10/1970 | Fed. Rep. of Germany | 66/118 |

*Primary Examiner*—Wm. Carter Reynolds

[57] ABSTRACT

An adjustable length circular knitting needle assembly includes a pair of knitting needles having distal pointed ends and a cord extending between the proximal ends thereof. At least one of the needles is provided with a hollow tubular portion which houses a reel assembly to which one end of the cord is secured. The reel assembly includes a distal idler wheel and a proximal spool wheel, and an endless belt secured therebetween. The cord passes through the tubular portion and is secured to the endless belt. A folding tab handle is joined to the spool wheel shaft to rotate the spool wheel and drive the belt, permitting the cord to be taken up or released as desired. A slot or window is provided in the tubular portion to permit access to the tab handle without disassembly of the needle.

8 Claims, 6 Drawing Figures

ADJUSTABLE LENGTH CIRCULAR KNITTING NEEDLE

BACKGROUND OF THE INVENTION

The following United States Patents comprise the prior art closest to the present invention: U.S. Pat. Nos. 2,096,482; 2,102,600; 2,183,791; 2,242,880; 2,462,473; 2,633,720; 2,693,095; 2,694,910.

For many years circular knitting needles have been known and used in the prior art for the fabrication of hand crafted knit articles. Circular knitting needles generally comprise a pair of needle members, or points, which are provided with tapered distal ends and a cord or similar flexible member joining the proximal ends of the needles. Circular knitting needles have proven to be effective in knitting generally cylindrical articles such as skirts or the bodies of pull-over sweaters, due to the large amount of material which may be stored on the flexible member joining the needles. Circular needles are also handy in fitting the knit work in process to the intended user, since the points of the needles may easily be joined to prevent the loss of any stitches.

One major drawback of circular knitting needles known in the prior art is that the flexible member joining the needle members is fixed in length. For some knitting procedures such as the fabrication of a cylindrical article which tapers at one end, it would be convenient to be able to shorten or lengthen the flexible member joining the needle members. In other procedures, such as fitting a knit work in progress to the intended wearer, it is often necessary to transfer the article to a circular needle assembly having a longer flexible member, so that the possibility of dropping stitches is eliminated. Although one prior art teaching discloses a circular knitting needle in which the flexible member may be augmented by adding segments thereto, it should be noted that these segments cannot be added or removed while an article is supported thereon.

SUMMARY OF THE PRESENT INVENTION

The present invention generally comprises a circular knitting needle assembly in which the flexible member joining the needle members may be lengthened or shortened, as desired, whether or not a knit article is supported on the circular knitting needle assembly. Furthermore, the present invention provides for infinite adjustment of the length of the flexible member, so that the flexible member may be adjusted exactly to the desired length.

The circular knitting needle assembly of the present invention includes a pair of tubular needle members having distal pointed ends and a flexible member or cord joining the proximal ends thereof. At least one of the needle members is provided with a hollow tubular portion in which a reel assembly is secured. The reel assembly is retained inside the tubular needle by a proximal end cap which is threadly secured to the tubular needle portion.

The reel assembly includes a proximal spool wheel and distal idler wheel secured to and longitudinally spaced along a frame member which is dimensioned to be received with the tubular needle portion. An endless belt is secured between the two wheels. The flexible member, comprising a cord or similar element, presses through a hole in the proximal end cap and is secured to the endless belt. The cord is wound or unwound from the endless belt by rotation of the endless belt which is effected by the spool wheel.

The spool wheel is fixedly secured to a rotating pivot shaft which is supported by the frame member. Joined to one end of the pivot shaft is a folding tab-like handle which is adapted to be manually rotated to retract or release a portion of the cord. When the handle is disposed in the folded position, it engages the frame member and and prevents rotation of the spool wheel.

A slot or window is provided in the tubular needle portion adjacent to the handle. The tab handle may be unfolded through the window and employed to rotate the spool wheel and drive the belt to retract or release the desired amount of flexible cord. The procedure for lengthening or shortening the flexible cord may be carried out whether or not a knit article is supported on the flexible cord.

A salient added benefit of the construction of the present invention is that a selection of tubular needle portions of differing diameters and lengths may be threaded to the proximal end cap. All of the tubular needle portions are provided with the identical threaded end portions so that any of the tubular needle members may be interchangeably secured to the proximal end cap. Thus, stitch size as well as the length of rows of stitches in a given knit article may easily be varied.

A BRIEF DESCRIPTION OF THE DRAWING

DESCRIPTION OF THE PREFERRED EMBODIMENT

Figure 1:
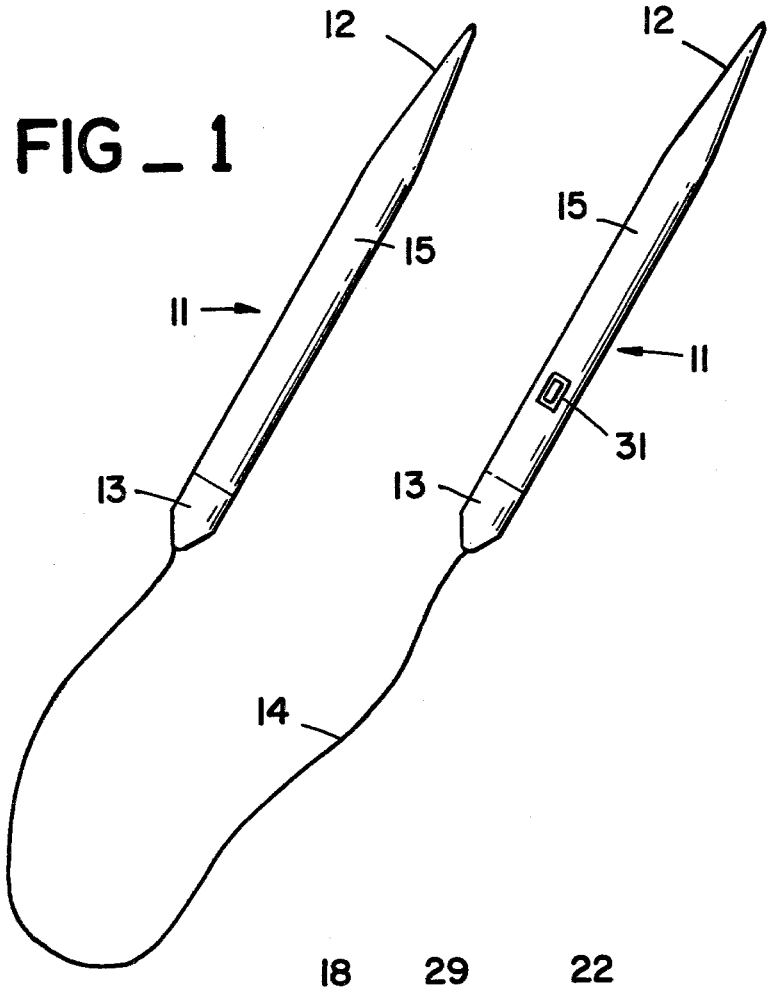
FIG. 1 is a perspective view of the circular knitting needle assembly of the present invention.

The present invention is generally characterized as a circular knitting needle assembly, as shown in FIG. 1, which includes a pair of knitting needles 11, which are provided with tapered, blunt knitting points 12 at like distal ends thereof. As is known in the prior art, the proximal ends of the knitting needles 11 are joined by a flexible cord or similar member 14 to support a knit article which is being constructed by the use of the knitting needles 11. A salient and novel feature of the present invention is that the flexible cord 14 is adapted to be lengthened or shortened to suit the size and requirements of the knit articles supported thereon.

Figure 2:
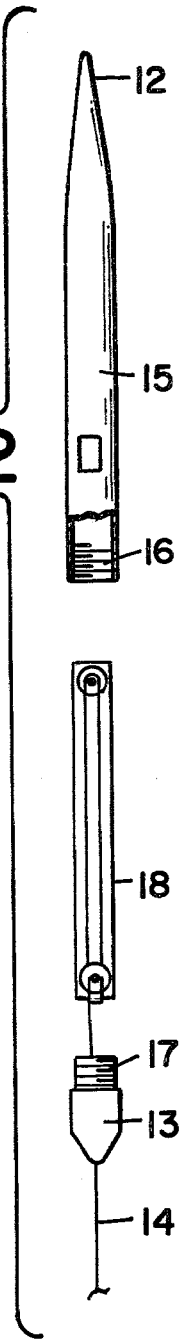
FIG. 2 is an exploded view of the circular knitting needle assembly of the present invention.

As shown in FIG. 2, at least one of the knitting needles 11 is constructed of a hollow tubular portion 15 which comprises the point 12 of the needle and also the shank portion of the needle. The proximal end of the member 15 is provided with internal threads 16. The needle member 11 also includes an end cap 13 which comprises a short hollow tubular member which is open at the distal end and tapered to a closed proximal end. The upper, open end is provided with external threads 17 which are adapted to be engaged by the threaded portion 16 of the member 15. A hole is provided in the center of the tapered closed end of the member 13, so that the flexible cord 14 may pass freely therethrough.

The circular knitting needles assembly also includes a reel assembly 18 which is disposed within the hollow tubular member 15. As shown in FIGS. 3–6, the reel assembly includes a longitudinally extending frame member 19 which is sufficiently narrow to be freely received within the tubular member 15. An idler pulley wheel 21 is joined to the distal end of the frame member 19 in rotatable fashion by means of a stub shaft or the like extending from the frame member. A spool wheel 22 is rotatably secured to the opposite end of the frame member 19 by means of a shaft 27 which also extends from the frame member 19. Each spool wheel includes a cylindrical core having a rim of substantially larger diameter than the core at the axially opposed ends thereof. An endless belt 29 is secured about the wheels 21 and 22, and adapted to rotate thereon to store a quantity of the flexible cord 14 which is wrapped thereabout in one or more layers.

Joined to the outer face of the spool wheel 22 is a folding handle 24. The handle 24 is hingedly secured to the outer face of the spool wheel 22 so that it may be pivoted independently of the spool wheel 22 in a plane common with the axis of the shaft 27 on which the spool wheel 22 is secured. The handle 24 may also be rotated about the axis of the shaft 27 to effect rotation of the spool wheel 22 and the endless belt 29.

The handle 24 is provided with a tab portion 26 extending orthogonally outwardly from the distal end thereof. The tab portion 26 is provided to facilitate manual actuation of the handle 24, so that it easily may be used to rotate the spool wheel 22 and the belt 29. For this purpose the handle is disposed in the position shown in FIGS. 5 and 6.

Figure 5:
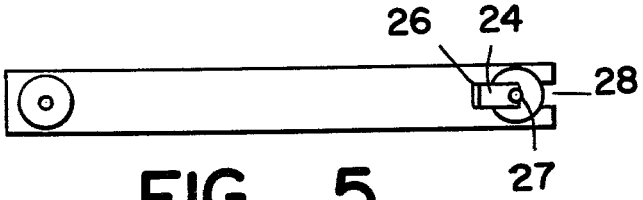
FIG. 5 is a side view of the reel assembly, shown in the unlocked position.
Figure 6:
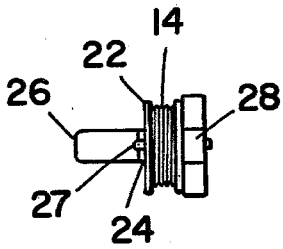
FIG. 6 is an end view of the reel assembly, shown in the unlocked position.

The tab portion 26 of the handle is also used to lock the spool wheel 22 and thereby prevent any of the cord 14 stored on the belt 29 from being removed therefrom. A detent slot 28 is disposed in the end of the frame member 19 directly adjacent to the spool wheel 22. With the handle 24 aligned with the axis of the frame member 19 and positioned in opposing relationship to the slot 28, as shown in FIG. 5, the handle may be folded so that the tab portion 26 is received in the detent slot 28. In this disposition, shown in FIG. 4, the spool wheel 22 is immoblized by the engagement of the tab in the detent slot.

Figure 3:
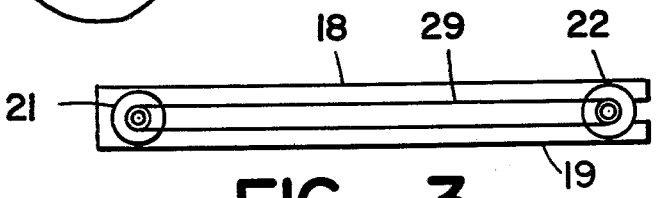
FIG. 3 is a longitudinal cross-sectional view of the reel assembly of the present invention.
Figure 4:
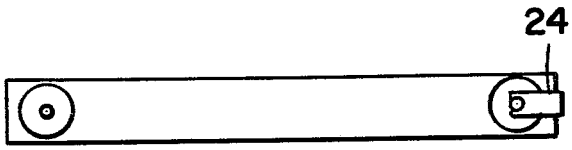
FIG. 4 is a side view of the reel assembly of the present invention, shown in the locked position.

With reference to FIGS. 2 and 3, the flexible cord 14 extending between the needle members 11 passes through the hole in the end cap 13, and is secured to the endless belt 29. The cord 14 is wound about the belt 29. This belt and spool arrangement reduces the amount of force which is applied to the spool wheel 22 by tension exerted on the portion of the flexible cord 14 extending between the needles 11 and facilitates the easy storage and removal of a substantial length of cord 14.

To lengthen or shorten that portion of the cord 14 which extends between the needles 11, a window 31 is provided in the tubular portion 15 adjacent to the handle 24. The handle 24 is unfolded through the window from its detent position, shown in FIG. 4 to its actuating position, shown in FIGS. 5 and 6. The handle may then be rotated to retract the desired portion of the cord 14 or the exposed portion of the cord may be tensioned to unwind the desired amount thereof from the belt 29. When the length of the cord 14 is adjusted as desired, the handle is again folded to the detent position within the window.

Another salient feature of the present invention is that a plurality of tubular members 15 having differing outside diameters may be secured to the end cap 13. Each of the tubular members 15 is provided with identical threaded portions 16 to engage the threads 19 of the end cap 13. In this way, the size of the knitting portions of the needles may be changed.

We claim:

1. An adjustable circular knitting needle assembly, comprising a pair of members having distal knitting points, a flexible member joining the proximal ends of said pair of members, first means for storing a portion of said flexible member within at least one of said pair of members and second means for selectively releasing or retracting a desired length of said flexible member from said first means; said first means including a reel assembly disposed within said one of said pair of members, said reel assembly including a frame member and a spool wheel secured to said frame member in rotatable fashion, and said second means including a handle associated with said spool wheel to effect rotation thereof.

2. The assembly of claim 1, wherein said one of said pair of members includes a hollow tubular portion.

3. The assembly of claim 2, wherein said one of said pair of members includes an end cap secured to an open end of said hollow tubular portion.

4. The assembly of claim 1, wherein said handle includes a lock tab extending therefrom.

5. The assembly of claim 4, wherein said handle is pivotable from a first, spool wheel rotating position to a second position in which said lock tab immobilizes said spool wheel.

6. The assembly of claim 4 further including a detent notch in said frame member for selectively engaging said lock tab.

7. An adjustable circular knitting needle assembly, comprising a pair of members having distal knitting points, a flexible member joining the proximal ends of said pair of members, first means for storing a portion of said flexible member within at least one of said pair of members and second means for selectively releasing or retractng a desired length of said flexible member from said first means; said first means including a reel assembly disposed within said one of said pair of members, said reel assembly including a frame member and a spool wheel secured to said frame member in rotatable fashion, a pulley wheel secured to said frame member in rotatable fashion, and an endless belt secured between said pulley wheel and said spool wheel.

8. The assembly of claim 7, wherein said flexible member is secured to said endless belt.

* * * * *